United States Patent [19]

Barrett

[11] Patent Number: 4,625,358

[45] Date of Patent: Dec. 2, 1986

[54] CHIMNEY CLEANING TOOL

[76] Inventor: Frederick G. Barrett, 611 SW. Cheltenham, Portland, Oreg. 97201

[21] Appl. No.: 762,256

[22] Filed: Aug. 5, 1985

[51] Int. Cl.[4] ..... F23J 3/02

[52] U.S. Cl. ..... 15/242; 15/104.18

[58] Field of Search ..... 15/104.16, 104.18, 162, 15/163, 242, 243, 249

[56] References Cited

U.S. PATENT DOCUMENTS 4,498,212 2/1985 Davis ..... 15/242

FOREIGN PATENT DOCUMENTS 261828 12/1928 Italy ..... 15/104.18

107403 5/1943 Sweden ..... 15/243

*Primary Examiner*—Edward L. Roberts

*Attorney, Agent, or Firm*—Glen A. Collett

[57] ABSTRACT

A chimney tool for cleaning the soot and creosote out of chimneys and stovepipes, including a pole, and on the end of the pole a bent-rod tool made of resilient material and having a lower shank attached to the end of the pole and mounting a scraper blade, an upper shank extending along the pole from the lower shank and also being attached to the pole at a distance from the end thereof, and a spring arm extending from the upper shank and mounting a roller wheel which engages the side of the chimney opposite from the scraper blade and biases the scraper blade against the inner wall of the chimney to scrape the soot and creosote therefrom, but having sufficient resilience to pass by obstructions in the chimney. The tool is moved up and down and simultaneously rotated to position the scraper blade successively around the circumference of the chimney.

18 Claims, 6 Drawing Figures

11
26
10
24
32
40
28
12
16
22
30
38
34
20
36
14
18

11
48
26
10
24
44
32
28
30
34
40
36
16
14
18

52
54
11
26
10
32
24
36
22
28
30
36
16
34
40
14
18

34
14
10
50
42

46
44
10
34
14
42

26
11
10
24
56
32
22
30
28
34
38
16
36
18
14
20

CHIMNEY CLEANING TOOL

BACKGROUND OF THE INVENTION

The present invention is an apparatus for cleaning a chimney, stovepipe or the like, and particularly a tool for cleaning a round chimney or stovepipe connected to a wood-burning stove where there is a buildup of soot and creosote on the walls of the chimney.

It is commonly known that wood-burning stoves cause an accumulation of solids such as soot and creosote on the inside walls of the chimney due to the slow burning and the reduced draft accompanying the use of an airtight stove. Such accumulations are dangerous because they may ignite and cause a chimney fire, which then poses a hazard to the rest of the home. The commonly accepted method of dealing with the problem is to clean the chimney by running a brush through it, and this has long been the task of professionals called chimney sweeps. Because of the proliferation of airtight wood stoves over the last few years, the problems of cleaning one's chimney has fallen on increasing numbers of homeowners, since stoves are much more likely to cause a buildup in the chimney than are conventional fireplaces.

Brush-type equipment for use by the homeowner is available on the market, but is often expensive. This is compounded by the problem that a particular size brush is needed for each different diameter chimney. Since there are sometimes several sizes of chimney pipe in a stovepipe/chimney assembly, it requires that a number of different sized brushes be purchased. Further, rods for holding chimney brushes are of a particular configuration and are often expensive. Alternately, chimney brushes may be operated by the use of ropes and weights, but that is harder work than using a rod.

Scrapers for use in chimneys are found in the prior art. The drawback with using prior art scrapers deals with their poor adjustability, and also with their use around obstructions in the chimney such as screws, rivets or the like. While brushes are flexible and will pass by screws sticking into the interior of the pipe, prior art scrapers are rigid, catch on such obstructions, and are unable to pass.

Accordingly, it is the general object of the present invention to provide a tool for cleaning the soot and creosote buildup from the chimney and stovepipe of a wood-burning stove.

Another object is to provide a tool which, while in use, expands to fit variously sized chimneys.

Yet another object is to provide a tool which easily passes over and around obstructions in the chimney.

A further object is to provide a tool that connects easily with no special threaded coupling to a variety of poles which may be of plastic, metal, wood etc.

A still further object is to provide a tool which can be used from the top or bottom of the chimney.

Another object is to provide a tool which is easily and inexpensively manufactured.

Yet another object is to provide a tool which is easily used by the average homeowner on a regular basis.

These and other objects and advantages, and the manner in which they are achieved, will be made apparent as the specification and claims proceed, taken in conjunction with the drawings which illustrate the preferred embodiment.

SUMMARY OF THE INVENTION

In its basic concept, the present invention is a chimney cleaning tool for removing soot and creosote buildup in chimneys and stovepipes. It uses a pole which mounts a bent-rod tool having a lower shank which mounts a scraper blade, an upper shank which extends up the pole a distance and is also mounted at its other end, and a spring arm extending therefrom which mounts a roller wheel and a biases the scraper blade against the inner wall of the chimney. The tool is moved up and down by a person cleaning the chimney, and rotates to position the scraper blade successively around the circumference of the chimney.

DESCRIPTION OF THE PREFERRED EMBODIMENT

Figure 1:
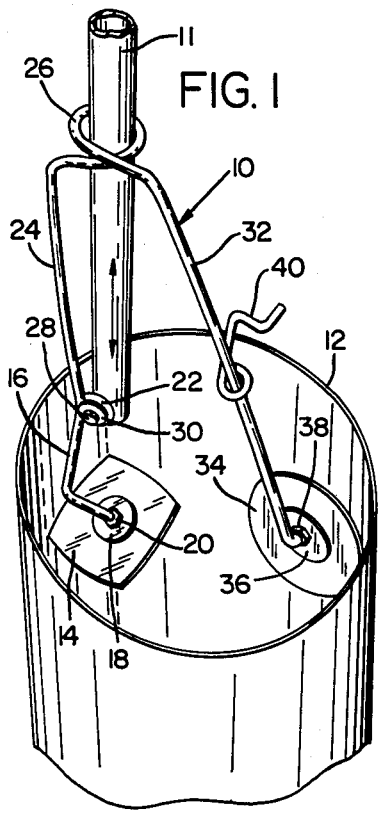
FIG. 1 is a top perspective view of the chimney cleaning tool of the present invention, shown entering a section of chimney or stovepipe.

As shown in FIG. 1, the chimney cleaning tool of the present invention includes a bent-rod assembly, generally denoted at 10, attached to a pole 11 for plunging into and along the length of a chimney or stovepipe 12. The rod mounts a scraper blade 14 by washers 18 and nuts 20, which is operable to scrape along the inner side wall of the chimney to remove the buildup of soot and creosote thereon.

The bent-rod configuration includes a lower shank 16 which is attached to the pole by the rod being formed with a loop 22 through which extends a bolt 28 having a washer 30, which also extends through a hole in the end of pole 11. The lower shank is bowed outwardly a distance just slightly less than the extension of the scraper blade 14. This is so when the tool is pulled into the end of a pipe or from a larger pipe into a smaller one the scraper blade will not hang up. The same rod continues, from loop 22, with an upper shank 24 extending along pole 11. It is again attached to the pole at the other end thereof by preferably being configured into a horizontal loop 26, having an axis substantially parallel to the axis of the pole, the loop encircling the pole. Continuing therefrom is a spring arm 32 which extends outwardly from the pole and mounts a roller wheel 34 by washers 36 and nuts 38. The spring arm biases the scraper blade into the opposite wall of the inside of the chimney.

Figure 2:
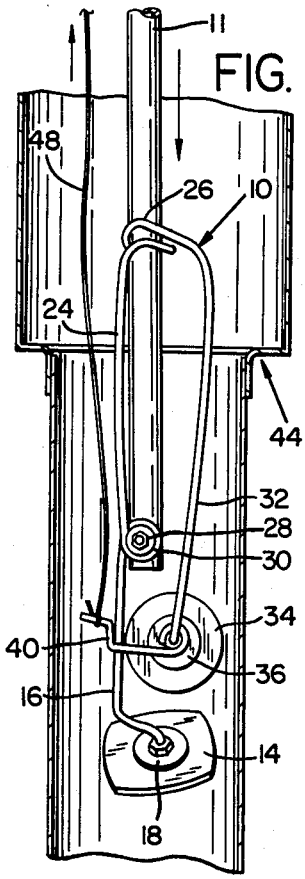
FIG. 2 is a sectional view of part of a chimney with the latched chimney tool being inserted thereinto.
Figure 6:
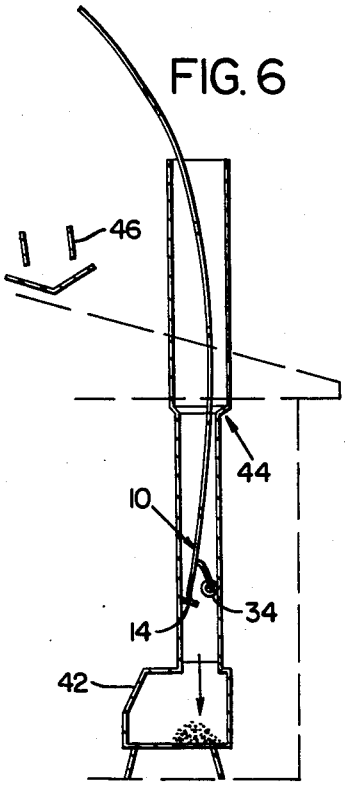
FIG. 6 is a schematic view of using the tool from the top of a chimney.

FIG. 2 shows that the tool can be held compressed for insertion from a larger chimney pipe to a smaller chimney pipe as in FIGS. 2 and 6. A latch 40 is connected to the spring arm 32 and is operable to overlap lower shank 16 or upper shank 24. FIG. 6 shows a stove 42 which is connected by a smaller stovepipe to a chimney 10, having a connecting flange 44. To get the chimney tool into the smaller pipe from above, the device is latched as shown and inserted into the chimney. When it is positioned at the bottom of the chimney a string 48 is pulled to unlatch the assembly. The string then comes off the latch and is pulled out. No such problem is encountered when pulling the device from a large area to a small area, because of the bow of lower shank 16 and the springiness of spring arm 32.

Figure 5:
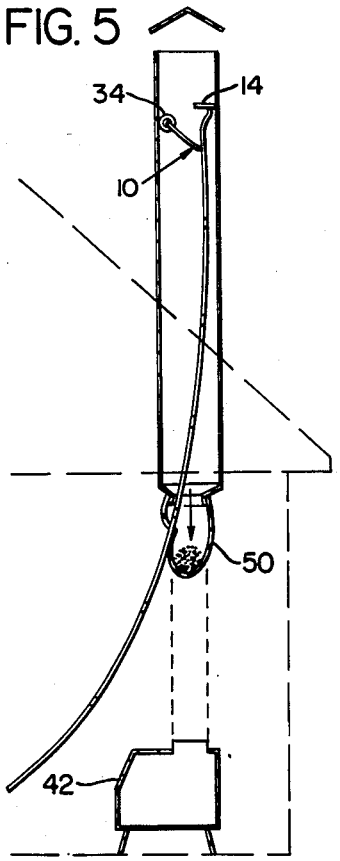
FIG. 5 is a schematic view of using the tool from the bottom of a chimney with the connecting stovepipe removed.

FIG. 5 shows that the chimney can be cleaned from the bottom in much the same way as it is cleaned from the top. Only the stovepipe is removed and cleaned separately, the chimney being cleaned as shown with a plastic sack 50 catching the soot.

Figure 3:
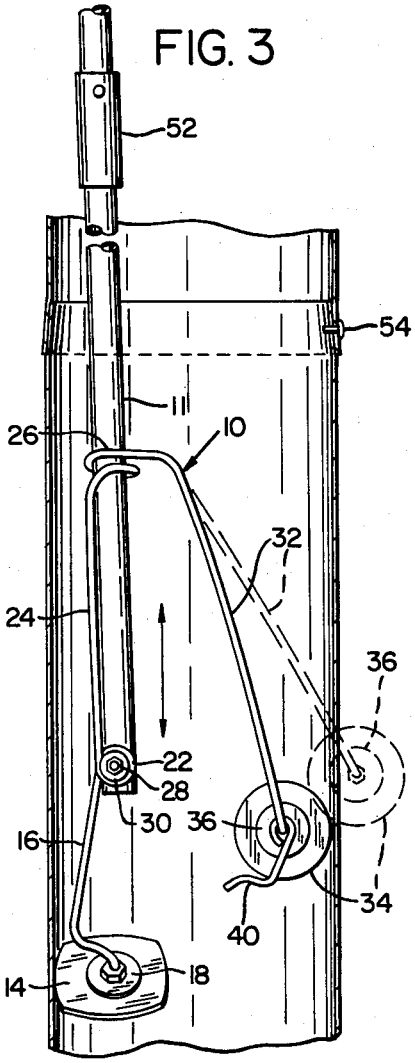
FIG. 3 is a side view of the chimney tool in working position in a section of chimney.

FIG. 3 shows that because of the springiness of the device a large range of pipe sizes may be cleaned. The most usual sizes of pipe are six or eight inches in diameter. However, the tool as configured is operable to function in pipes from four to ten inches in diameter. For chimneys over ten inches in diameter, a tool with a longer spring arm 32 would be used.

Depending on the length of the chimney, additional sections of pole may be added as shown in FIG. 3. Any pole of wood, metal or plastic etc. may be used, so long as it fits through loop 26. Preferably the pole is plastic pipe of nominal ½ inch size. It is sometimes convenient to use sections about five to ten feet in length, each connected together by securing their ends releasably with snap buttons in a connecting sleeve 52.

Screws which extend into the interior of the stovepipe, such as shown at 54 do not cause a problem for the presently described chimney tool. Scraper blade 14 preferably has a plurality of similar interchangable working surfaces, each having a radius of curvature larger than the radius of the blade itself. A scraper blade of this design is effective in all sizes of pipes. Further, the blade is preferably canted from horizontal about 30 degrees. Thus, when the pivotally mounted blade encounters an obstruction it has a tendency to roll off and begin using another scraper surface. In regular use all surfaces should wear approximately equally.

Figure 4:
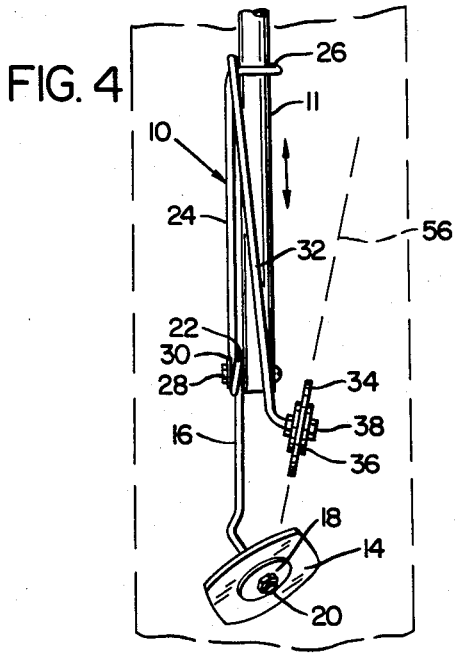
FIG. 4 is another side view, with the tool rotated one-quarter of a turn from FIG. 3, which shows angular relationships more clearly.

FIG. 4 illustrates that roller wheel 34 is preferably canted from vertical approximately 30 degrees. Thus, as the device is pushed and pulled the roller wheel imparts a twisting motion as shown along line 56. In use, the preferred method is to insert the tool to the far end of the chimney, work it in short stroke around the chimney, and then pull it back out in increments.

Both the roller wheel and the scraper blade may be made of metal or rigid plastic. If the creosote buildup is hard and thick the metal blade may be used. Also, it is possible to use a small round wire brush in place of the scraper blade. A plastic scraper blade will not scratch the chimney and is used for removal of lighter soot deposits.

Having described my invention in its preferred embodiment, I claim:

1. A chimney tool for removing soot and creosote buildup from substantially round chimneys, stovepipes and the like, comprising:

(a) a pole for manipulation by a person;

(b) a resilient rod mounted on the pole and being bent to a configuration including:

(1) a lower shank mounted on the end of the pole and extending therefrom;

(2) an upper shank extending along the pole from the lower shank and also being mounted on the pole at the other end thereof;

(3) a spring arm extending from the upper shank and angling outwardly from the pole;

(4) a loop between the lower shank and the upper shank, and wherein the rod is attached to the pole by a bolt passing through the loop and through a hole in the pole; and (5) a loop formed between the upper shank and the spring arm, the loop being about an axis substantially parallel to that of the pole, and mounting the rod by encircling the pole;

(c) a scraper blade mounted rotatably on the end of the lower shank and having a plurality of similar interchangable working surfaces to engage the inside of the chimney; and (d) a roller wheel mounted rotatably on the end of the spring arm and being engagable with the side of the chimney opposite the scraper blade.

2. The tool of claim 1 wherein the roller wheel is canted from vertical to impart a rotational twist to the tool as it is worked longitudinally.

3. A chimney tool for removing soot and creosote buildup from substantially round chimneys, stovepipes and the like, comprising:

(a) a pole for manipulation by a person;

(b) a resilient rod mounted on the pole and bent to a configuration including:

(1) a lower shank mounted on the end of the pole and extending therefrom;

(2) an upper shank extending along the pole from the lower shank and also being mounted on the pole at the other end thereof; and (3) a spring arm extending from the upper shank and angling outwardly from the pole;

(c) a scraper blade mounted on the end of the lower shank and having a configuration to engage the inside of the chimney; and (d) a roller wheel mounted rotatably on the end of the spring arm and being engagable with the side of the chimney opposite the scraper blade.

4. The tool of claim 3 wherein the rod configuration further includes a loop between the lower shank and upper shank, and wherein the rod is attached to the pole by a bolt passing through the loop and through a hole in the pole.

5. The tool of claim 3 wherein the rod configuration further includes a loop formed between the upper shank and the spring arm, the loop being about an axis substantially parallel to that of the pole, and mounting the rod on the pole by encircling the pole.

6. The tool of claim 3 wherein the lower shank is bowed outwardly, generally in a direction opposite the spring arm to a distance slightly less than the extension of the scraper blade.

7. The tool of claim 3 wherein the scraper blade is canted from horizontal.

8. The tool of claim 3 wherein the roller wheel is canted from vertical.

9. The tool of claim 3 wherein the scraper blade is mounted rotatably on the lower shank.

10. The tool of claim 9 wherein the scraper blade has a plurality of similar interchangable arcuate working surfaces on its periphery, each having a radius of curvature larger than the blade itself.

11. The tool of claim 3 wherein the scraper blade is of rigid plastic material.

12. The tool of claim 3 wherein the scraper blade is of metal material.

13. The tool of claim 3 wherein the spring arm is of a length that when the spring arm is compressed the roller wheel is positioned between the end of the pole and the scraper blade.

14. The tool of claim 3 further comprising a latch holding the spring arm in a compressed position, and means for the person to trip free the latch from a distance from the end of the pole.

15. The tool of claim 3 wherein the pole is made of plastic pipe.

16. The tool of claim 15 wherein the pole is sectional, each section being secured to the next by inserting and releasably securing the ends thereof into a connecting sleeve.

17. The tool of claim 3 wherein the lower shank is configured so that the pole is in line with the center of the scraper blade.

18. The tool of claim 3 wherein the pole is flexible for curving in the chimney and out the ends thereof.

* * * * *